US006543706B1

(12) United States Patent
Hutchings et al.

(10) Patent No.: US 6,543,706 B1
(45) Date of Patent: Apr. 8, 2003

(54) FUEL INJECTION NOZZLE FOR AN INTERNAL COMBUSTION ENGINE

(75) Inventors: Todd Hutchings, Cedar Springs, MI (US); Donna Mosher, Dorr, MI (US); Bruce Gillum, Kalamazoo, MI (US)

(73) Assignee: Diesel Technology Company, Kentwood, MI (US)

( * ) Notice: Subject to any disclaimer, the term of this patent is extended or adjusted under 35 U.S.C. 154(b) by 0 days.

(21) Appl. No.: 09/827,486

(22) Filed: Apr. 6, 2001

Related U.S. Application Data

(63) Continuation-in-part of application No. 09/636,587, filed on Aug. 10, 2000, now abandoned, which is a continuation of application No. 09/258,574, filed on Feb. 26, 1999.

(51) Int. Cl.[7] ..... F02M 39/00

(52) U.S. Cl. ..... 239/533.3; 239/533.8; 239/533.9

(58) Field of Search ..... 239/533.2, 533.3, 239/533.4, 533.5, 533.6, 533.7, 533.8, 533.9, 88, 89, 95

(56) References Cited

U.S. PATENT DOCUMENTS

| | | | | |
|---|---|---|---|---|
| 2,173,814 | A | | 9/1939 | Bischof |
| 2,425,229 | A | * | 8/1947 | Bremser |
| 3,006,556 | A | | 10/1961 | Shade et al. |
| 3,566,849 | A | | 3/1971 | Frick |
| 4,129,253 | A | | 12/1978 | Bader, Jr. et al. |
| 4,392,612 | A | | 7/1983 | Deckard et al. |
| 4,408,718 | A | | 10/1983 | Wich |
| 4,463,900 | A | | 8/1984 | Wich |
| 4,470,545 | A | | 9/1984 | Deckard et al. |
| 4,550,875 | A | | 11/1985 | Teerman et al. |
| 4,565,320 | A | | 1/1986 | Taniguchi et al. |
| 4,618,095 | A | | 10/1986 | Spoolstra |
| 4,934,599 | A | | 6/1990 | Hasagawa |
| 5,323,964 | A | | 6/1994 | Diszpoly et al. |
| 5,402,944 | A | | 4/1995 | Pape et al. |
| 5,464,158 | A | * | 11/1995 | Hofmann |
| 5,553,781 | A | * | 9/1996 | Barkhimer et al. |
| 5,727,738 | A | | 3/1998 | Hofmann et al. |
| 5,749,717 | A | | 5/1998 | Straub et al. |
| 5,954,487 | A | | 9/1999 | Straub et al. |
| 6,059,204 | A | * | 5/2000 | Augustin |

* cited by examiner

*Primary Examiner*—Christopher S. Kim
(74) *Attorney, Agent, or Firm*—Brooks & Kushman P.C.

(57) ABSTRACT

A fuel injection nozzle controls the flow of pressurized fluid through a nozzle opening. The fuel pump includes a fuel valve under the control of an electronic engine control module to effect sequential ON/OFF cycles for the fuel valve to establish a pilot fuel delivery pulse through the nozzle followed by a full fuel delivery injection pulse, a damping flow passage in the nozzle, and a flow damping pin in the opening through which fuel flows as the needle valve displaces fuel, the damping pin being biased toward an injection nozzle closed position by a needle valve spring whereby a distinct pilot pulse of fuel is delivered through the nozzle in advance of delivery of a full injection pulse, the valve spring being in a spring chamber that is pressurized to effect a rapid needle valve closure at the end of the fuel delivery pulse.

6 Claims, 5 Drawing Sheets

FUEL INJECTION NOZZLE FOR AN INTERNAL COMBUSTION ENGINE

CROSS-REFERENCE TO RELATED APPLICATIONS

This application is a continuation-in-part of U.S. application Ser. No. 09/636,587, filed Aug. 10, 2000, now abandoned, which is a continuation of U.S. application Ser. No. 09/258,574, filed Feb. 26, 1999, now abandoned.

BACKGROUND OF THE INVENTION

1. Field of the Invention

The invention relates to internal combustion engines, particularly a fuel injection nozzle for delivering fuel to the fuel combustion chamber of an engine.

2. Background Art

A fuel injection pump for a conventional internal combustion engine, such as a diesel engine, comprises a pump plunger or piston situated in a pump cylinder to define a high pressure pumping chamber. The plunger is driven with a pumping stroke by an engine rocker arm for intake and exhaust valves for the engine or by some other camshaft driven member. The stroking of the plunger thus is related directly to engine speed.

A low-pressure fuel pump supplies the pumping chamber with fuel. A fuel control valve having open and closed states is located in a fluid supply passage between the outlet side of the low-pressure fuel pump and the pumping chamber for the fuel injection pump. An electronic engine controller repeatedly and sequentially changes the state of the fuel control valve from a flow open state to a flow closed state during a predetermined cycle time so that an initial pilot pulse of fuel is delivered to an injection nozzle in advance of the delivery of the full injection pulse. The presence of the pilot pulse contributes to more efficient burning of the fuel in the combustion chamber of the engine, thereby reducing undesirable exhaust gas emissions and increasing the combustion temperature of the fuel. This improves the combustion efficiency and promotes complete burning of the fuel delivered by the full injection pulse.

In a conventional fuel injection system, the controller lacks the ability to establish a definitive pilot pulse that precedes the development of the full injection pulse. This is due, in part, to an inherent delay in the development of injection pressure following a so-called ON command to the control valve by the controller. It is due also to the inability of the control valve to terminate a fuel pressure buildup at the injection nozzle following a so-called OFF command by the controller to close the control valve.

In the control of the fuel delivery in response to the ON/OFF commands of the controller, the pilot fuel delivery pulse blends into the full injection pulse so that fuel delivery through the injection nozzle occurs during a single, extended fuel injection event. This imprecision in the establishment of a pilot pulse in advance of the full injection cycle makes controlled fuel metering difficult. Excess fuel is delivered during each injection cycle, which may result in instability in combustion in the engine combustion chamber and excess undesirable exhaust gas emissions.

The lack of precision in the delivery of fuel pulses in conventional fuel injection systems makes it more difficult to achieve constant volume combustion of the fuel/air mixture in the combustion chamber. Complete combustion should occur with a minimum travel of the piston. This feature is difficult to achieve if the fuel pulses are blended, during an extended injection event, with no controlled interval between the pulses. Constant volume combustion will contribute to more efficient fuel economy.

SUMMARY OF THE INVENTION

It is an objective of the invention to overcome imprecision in the delivery of fuel pulses by a fuel injection nozzle in a fuel injection engine by providing a distinct, controlled pilot pulse in advance of the full fuel injection pulse. This creates a controlled interval between the two pulses so that more efficient fuel burning in the combustion chamber can be achieved. The invention includes a fuel nozzle at the fuel delivery side of a pumping chamber for a fuel injector that is driven by an engine rocker arm or some other engine-driven element. The fuel injector has a plunger that reciprocates in a fuel injection cylinder. During the pumping stroke of the plunger, fuel is transmitted under high pressure to a fuel spray orifice in the nozzle. The orifice is controlled by a needle valve that responds to a pressure buildup at the orifice.

The needle valve is moved into sealing engagement with the nozzle so that the needle valve tip can control the opening and closing of the orifice. The needle valve is biased by a valve return spring toward the orifice closing position and is biased by fuel pressure against an opposing force of the spring at a predetermined fuel pressure level developed by the plunger as it is stroked in the pumping chamber.

A damper plate is situated between the needle valve return spring and the tip of the needle valve. The needle valve cooperates with the damping plate to define an accumulator with an accumulator chamber. As the needle valve is stroked to its open position, the accumulator displaces fuel through an accumulator leak path formed in the damping plate. The leak path is defined in part by a damper pin, which cooperates with the damping plate to define a restricted flow path for the fuel as the fuel is displaced from the accumulator chamber by the needle valve. This produces a damping effect, which decreases the rate the needle valve opens. The decreased opening rate prevents the needle valve from achieving a fully opened state during the development of a short pilot injection pulse.

The damper plate and the damping pin control the speed at which the needle valve moves from the orifice closing position to the fully open position. The damping feature acts in synchronism with the ON/OFF cycles delivered by the controller to the fuel control valve so that an OFF command for the fuel control valve is established prior to the development of the peak value for the pilot pulse. Further, the ON command for the fuel valve occurs after the pilot pressure has decreased to approximately the threshold value that normally exists when the needle valve assumes an orifice open position. The outset of the full injection pulse occurs following a calibrated delay from the instant the ON command is delivered to the fuel control valve so that the development of the fuel injection pulse occurs with a calibrated, controlled delay following the peak pilot pulse pressure. In this way, a blending of the two pulses into a single, long injection event is avoided.

The nozzle has a nozzle tip portion in which the fuel spray orifice is formed. The needle valve is in the nozzle tip portion.

A first end of the needle valve engages the nozzle tip portion and closes the orifice when the needle valve assumes a first position.

A fuel flow passage is defined by a clearance between the damper plate and the damper pin. This is a calibrated clearance, which provides a flow restriction. The damper pin extends into the accumulator chamber, whereby fluid displaced from the accumulator chamber by the needle valve, as the needle valve is shifted under pressure toward the damper plate, passes through the flow restriction.

A compression spring in the nozzle body acts on the damper pin, thereby opposing movement of the needle valve under a differential pressure acting on the needle valve. The compression spring engages a movable spring seat, which is engaged by the damper pin. In accordance with one feature of the invention, the spring chamber in the nozzle body is in restricted communication through a flow control orifice with a high pressure fuel delivery passage extending to the injection nozzle. The pumping stroke of the plunger increases the pressure in the fuel delivery passage, as explained. This, in turn, results in a delayed pressure buildup in the spring chamber because of the restricted flow passage between the high pressure fuel delivery passage for the needle valve and the chamber occupied by the spring. The pressure in the spring chamber creates a hydraulic force that complements the force of the spring acting on the damper pin. This causes the forces acting on the needle valve to be more closely balanced, thereby permitting the use of a reduced stress spring or a reduced spring rate.

The pressure in the spring cage trails the injection pressure during the injection cycle because of the flow metering effect of the control orifice between the high pressure fuel delivery passage and the spring chamber. The resulting pressure difference between the pressure in the fuel delivery passage for the needle valve and the pressure in the spring chamber does not interfere with the opening of the valve. The valve will pop open when a threshold pressure is achieved to create a pressure differential force to oppose the spring force. The pressure differential will, however, provide a cleaner and crisper end of the injection cycle. This potentially lowers the undesirable emissions from the engine and improves engine operating efficiency.

Because of the presence of fuel pressure acting on the damper pin, the closing of the needle valve occurs much more rapidly relative to the rate of closing of the needle valve if the damper pin is subjected solely to spring force.

Any leakage of fuel under pressure past the damper pin can be drained through a drain hole located at an intermediate position in the damper pin opening. The drain hole extends to a low pressure drain passage.

The response time of the needle valve to an OFF command of the control valve is greatly improved, thereby providing a more definitive termination of a pilot pulse before the initiation of a main injection pulse.

DETAILED DESCRIPTION OF THE PREFERRED EMBODIMENT(S)

Figure 1:
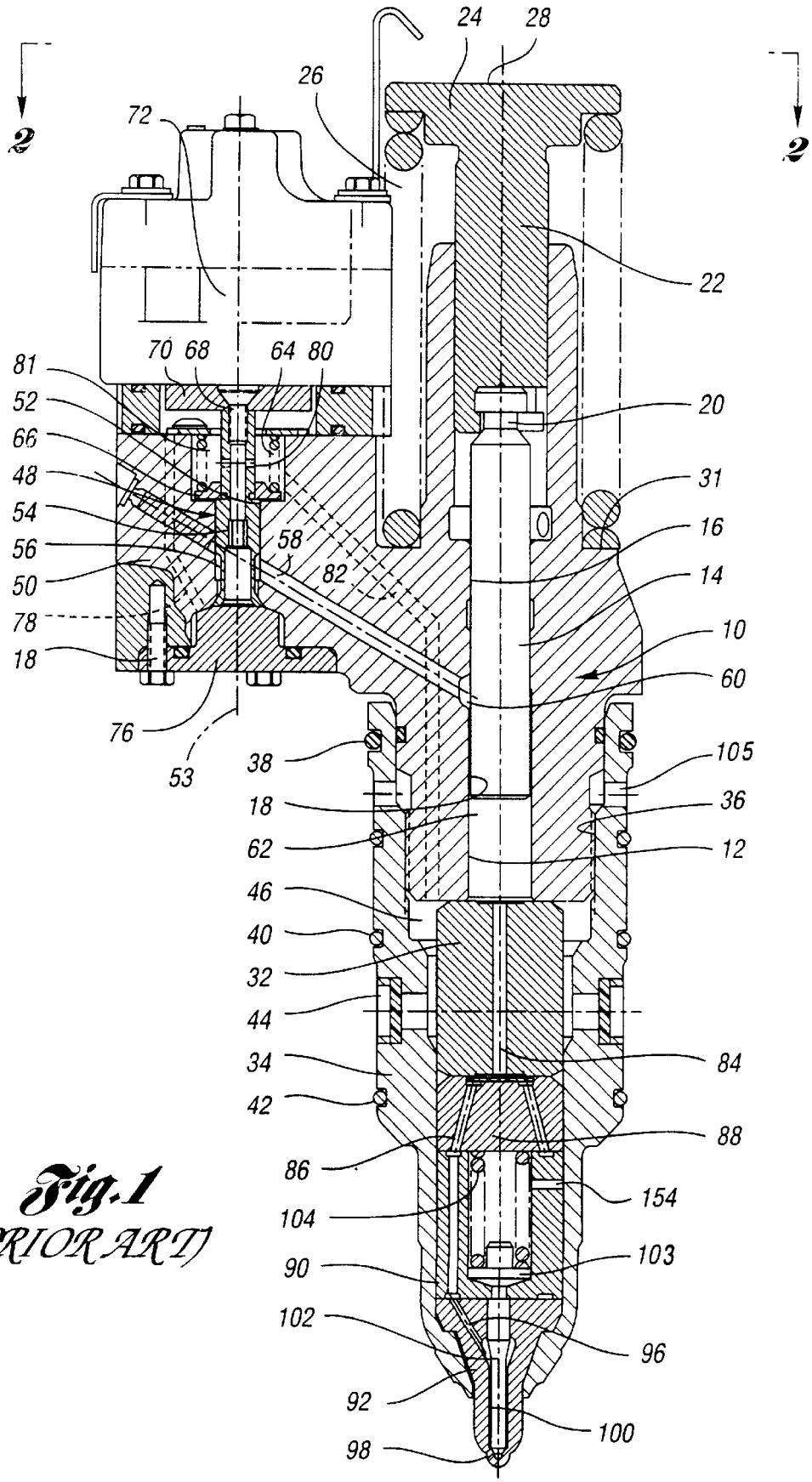
Fig. 1 (PRIOR ART)
FIG. 1 is a cross-sectional assembly view of a fuel injection pump, a fuel control valve and a fuel injection nozzle for supplying fuel to the combustion chamber of an internal combustion engine, such as a diesel engine.
Figure 2:
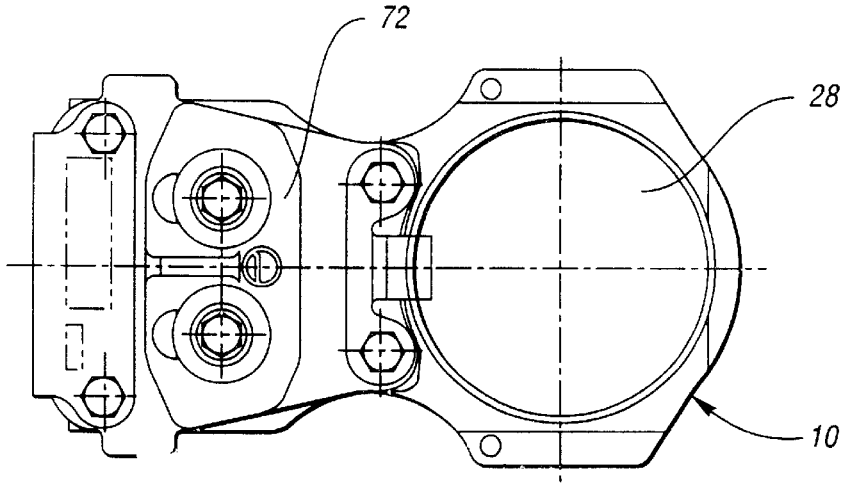
Fig. 2 (PRIOR ART)
FIG. 2 is an end view of the assembly of FIG. 1 as seen from the plane of section line 2—2 of FIG. 1.
Figure 4:
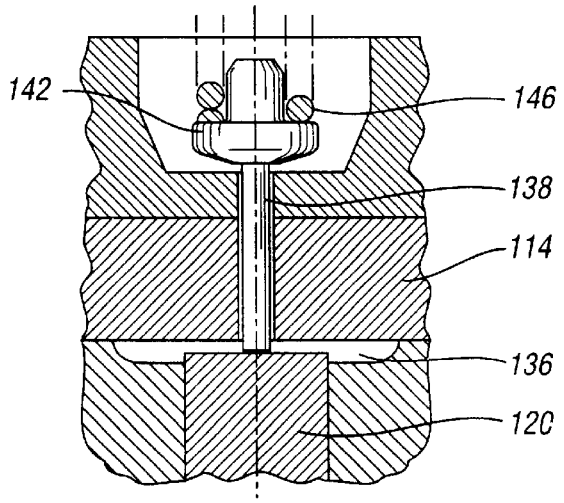
FIG. 4 is a detailed view of the improved nozzle assembly of the invention.
Figure 5:
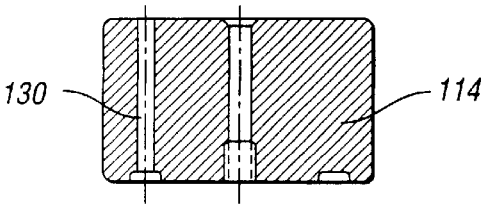
FIG. 5 is a detailed view of a damping plate used in the assembly of FIG. 3.
Figure 6:
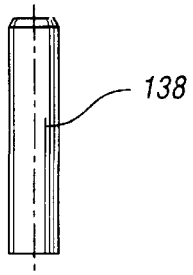
FIG. 6 is a detailed side view of the damping pin that is included in the assembly view of FIG. 3.

In FIG. 1, numeral 10 designates a known injector pump housing having a pumping cylinder 12, which receives a reciprocating plunger 14. The diameter of the cylinder substantially matches the diameter of the cylinder 16. The cylinder is provided with a diameter that establishes a controlled clearance 18 between the plunger 14 and the cylinder 12.

The top end of the plunger 14 is secured, preferably by a mechanical interlock 20 resembling a bayonet lock, to a plunger 22. A spring seat plunger head 24 is engaged by compression spring 26. The plunger 22 reciprocates in the end of the injector housing 10.

The spring seat and plunger head 24 has a surface 28 that is engaged by a rocker arm for the intake and exhaust valves for the engine or to a camshaft-driven element, the rotary speed of which is directly related to engine speed. A spring reaction force acts on a spring seat shoulder 31 formed on the housing 10. A cylindrical member 32, received within nozzle housing 34, is located directly adjacent one end of the injector pump housing 10. The nozzle housing 34 is threaded at 36 on the injector pump housing 10. Fluid seals 38, 40 and 42 located in seal grooves in the nozzle housing 34 establish a seal for the nozzle housing as it is inserted in an opening in the cylinder head for the engine (not shown).

A low-pressure fuel feed port 44, formed in the nozzle housing 34, communicates with annular space 46 in the nozzle housing 34. The port 44 communicates with a pressure outlet side of a low-pressure fuel pump (not shown).

A fuel control valve assembly is generally indicated at 48. It is located in control valve housing 50, which may be part of the pump housing 10. Preferably, the housing 50 and the housing 10 may be a single unit.

Housing 50 defines a valve chamber 52, which receives a sliding valve element 54. An annular groove 56 is formed on the valve element 54 for receiving fuel to be supplied through fuel delivery passage 58. One end of the passage communicates with cylinder 12, as shown at 60.

The cylinder 12 and the plunger 14 define a pumping chamber 62, which communicates with the passage 58 through a clearance between the cylinder wall and the plunger 14, as indicated at 18.

The spool valve element 54 of the valve 48 is slidably positioned in valve chamber 52 and is urged to an open position by valve spring 64, which is seated on valve seat 66. The outboard end of the spool valve element 54 is secured by fastener 68 to an armature 70. A solenoid actuator, generally designated at 72, includes solenoid windings, which act on armature 70 to shift the armature 70 to a closed position when the windings are energized. The solenoid is energized by an electronic controller for the engine. The controller includes a module for establishing ON and OFF signals for the valve 48, causing the valve to open and close in response to instructions developed by the engine controller software.

The lower end of the spool valve element 54 engages a stop 76, which is secured by suitable fasteners 18 to the valve housing 50. The valve element 54 is hollow. It has radial ports 80, thereby equalizing the pressure forces acting in the direction of the valve axis 53.

The end of the valve 54 that engages the stop 76 has a conical valve surface that engages a cooperating conical valve seat formed at the surrounding end of the valve chamber 52. When the valve element 54 is shifted toward the stop 76, the valve element 54 opens, thereby establishing communication between annular groove 56 and an internal passage 78 formed in the valve housing 50. Passage 78 extends into spring chamber 81 at one end of the valve chamber 52. The spring chamber and an internal fuel supply passage 82 distribute fuel to the passage 78 and to the annular groove 56 whenever the controller moves the valve spool 54 to its open position. Internal feed passage 82 communicates with annular groove 56.

When the controller energizes the solenoid windings of the actuator 72, the valve spool 54 interrupts fluid communication between supply passage 82 and the annular groove 56. The valve assumes its closed position when the plunger 14 of the fuel pump is stroked to initiate a pressure pulse in the fuel being delivered to the nozzle.

The cylindrical member 32 has an internal opening 84, which communicates with fluid distributor passages 86 in a spacer 88. A spring housing 90 is situated directly against the spacer 88 and engages a nozzle tip portion 92. The tip portion is formed with fuel delivery passages 96, which distribute fuel from the distributor passages 86 to a nozzle spray orifice 98. Nozzle spray orifice 98 communicates with the passages 96 through the annular space 100 in the tip portion 92.

A needle valve 102 is located in the annular space 100. It engages a spring seat 103 positioned in the central opening of the spring housing 90. The needle valve is biased toward an orifice closing position by valve spring 104.

When the pressure developed by the plunger 14 in the pumping chamber 62 is distributed through passage 84, distributor passages 86 and annular space 100, it develops a force on the needle valve 102 that opposes the force of the spring 104. When the fuel pressure reaches a predetermined threshold value such as 5000 psi, the valve 102 will shift to open the fuel nozzle orifice. Internal fluid return passages (not shown) in the pump housing 10 accommodate the flow of fluid leaking past the plunger to a low-pressure outlet port shown at 105.

Figure 9:
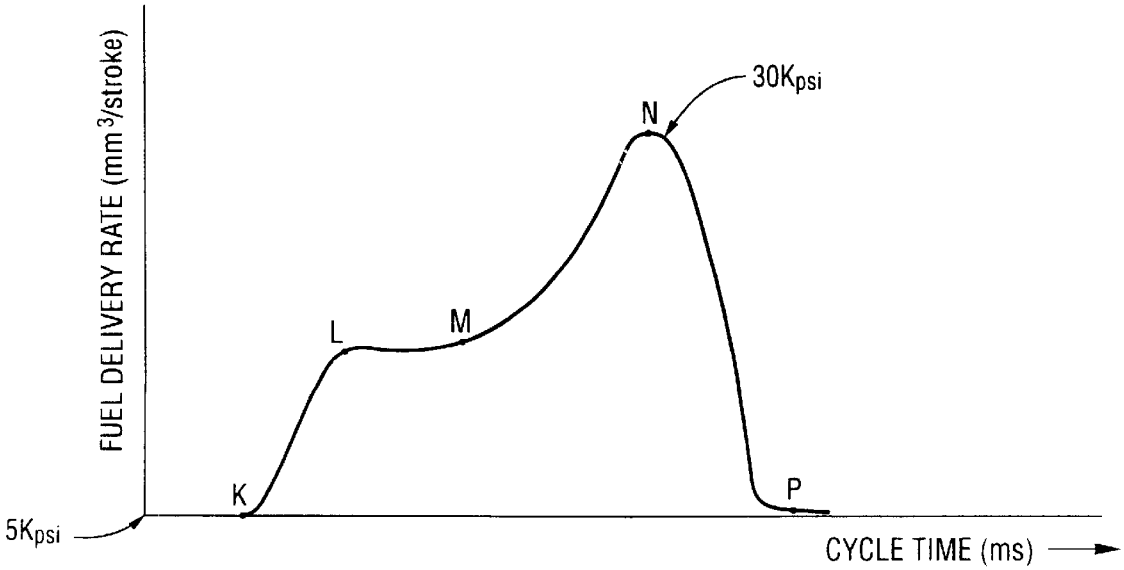
Fig. 9 (PRIOR ART)
FIG. 9 is a plot, similar to the plot of FIG. 8*a*, which represents the fuel delivery rate for a conventional fuel nozzle during an injection event. It is included for purposes of comparison with FIG. 8*a*.

When successive ON and OFF signals are delivered to the solenoid actuator 72, the pressure developed by the plunger 14 is distributed to the nozzle to effect an initial pilot fuel delivery pulse to the combustion chamber. That is followed by second ON/OFF signals from the engine controller, which establish a full injection pulse. Because of the inertia of the fuel and the response time of the movable elements of the system to the ON and OFF commands of the controller, the pilot pulse of the conventional injector of FIG. 1 tends to blend into the full injection pulse with no clear distinction between the two pulses. This is illustrated, for example, in FIG. 9 where an initial command to open the control valve assembly results in an initial pressure buildup beginning at point K until a peak value at L is reached for the pilot pulse. The controller issues a valve close command at a point between points K and L in FIG. 9. A valve open command at point M is intended to initiate the beginning of full injection pulse. Because of the blending of the two pulses between cycle time L and cycle time M, the fuel delivery to the nozzle orifices remains relatively constant. It does not fall to the threshold fuel delivery level indicated at the initial cycle time point K.

At a location between point M and point N, the controller commands the control valve assembly to close. The inertia of the fuel and the movable elements of the control system will allow a continuation of the pressure buildup until the peak value is reached at point N. The pressure value then will fall to the initial value indicated at point P. The fuel delivery event then is completed. It is followed by subsequent pilot pulses and full injection pulses in sequence.

Figure 3:
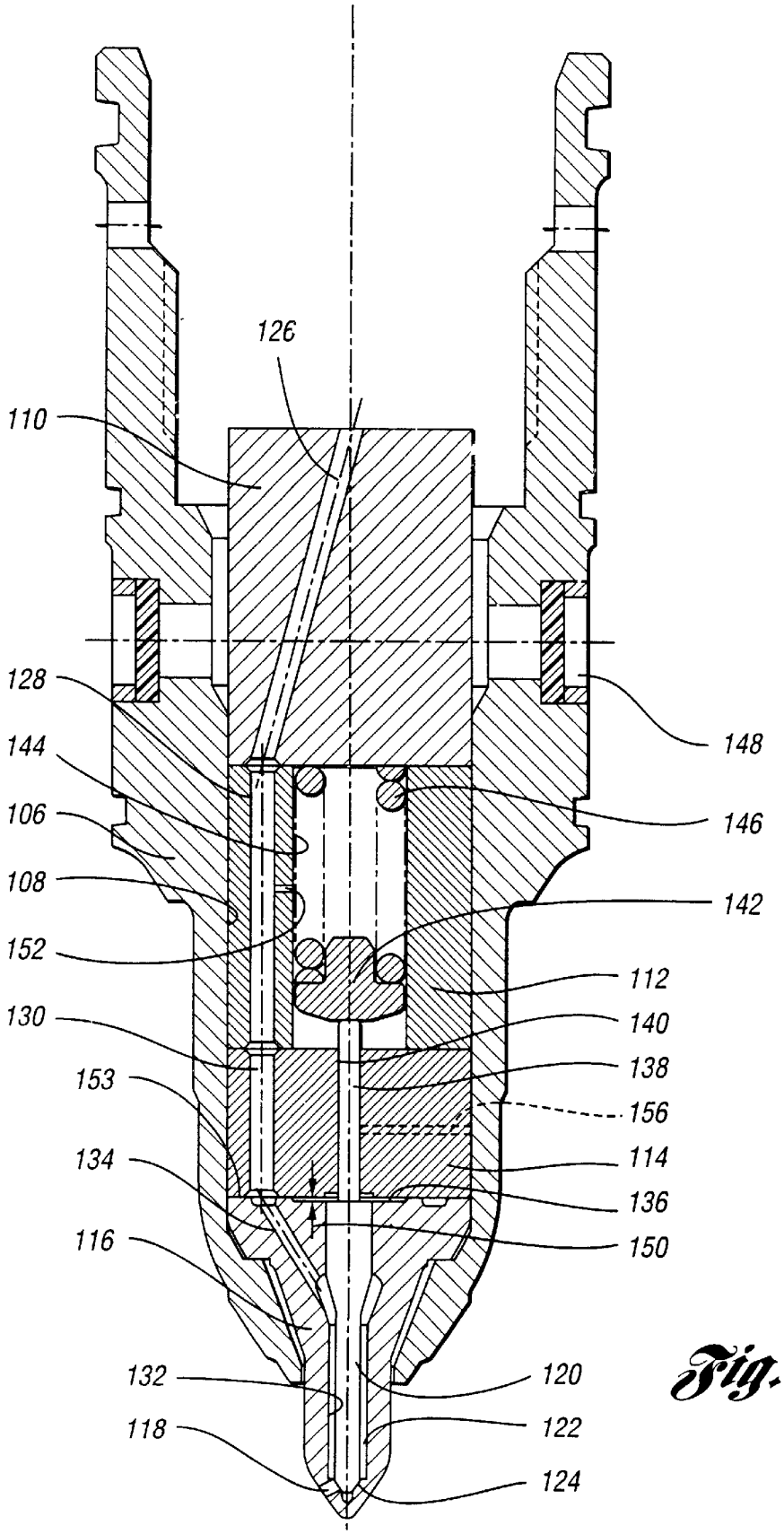
FIG. 3 shows a cross-sectional view of a fuel injection nozzle assembly that includes the features of the invention.

The improved nozzle and damping pin assembly of the invention is shown in FIG. 3. The operating characteristic of the assembly of FIG. 3 will be described with reference to FIG. 8 in order to contrast it with the performance characteristic shown in FIG. 9.

The nozzle assembly of FIG. 3 includes a housing member 106, which corresponds to member 34 of the nozzle assembly of FIG. 1. Member 106 has a cylindrical interior opening 108, which receives a cylindrical member 110 corresponding to the member 32 of the nozzle of FIG. 1. A damper plate comprising a cylindrical insert 114 is located intermediate cylindrical member 112 and a nozzle tip portion 116. The end of the tip portion 116 is provided with a plurality of fuel spray orifices, one of which is shown at 118.

A needle valve 120 is situated in a central opening 122 of the tip portion 116. The end of the needle valve 120 has a conical surface 124 which engages an internal conical needle valve seat in the tip portion 116. When the needle valve is seated against the conical valve seat of the tip portion 116, the orifices 118 are blocked.

Member 110 has an internal fuel flow passage 126, which communicates at one end thereof with the pumping chamber of the fuel pump. That chamber corresponds to the chamber 62 of the nozzle assembly illustrated in FIG. 1.

Member 112 has an internal fluid flow passage 128 which extends between passage 126 and a needle valve fuel feed passage 130 formed in the damper plate 114.

The tip portion 116 has an annular fuel delivery passage 132 defined by the needle valve 120 and the opening 122. That annular passage communicates with passage 130 through fuel delivery passage 134 in the tip portion 116.

An accumulator chamber 136 is situated between the damper plate 114 and the top end of the needle valve 120. The tip portion 116 is formed with a recess that cooperates with the adjacent surface of the damper plate 114 to define accumulator chamber 136.

A damping pin 138 is situated in a central opening 140 formed in the damper plate 114. One end of the damping pin 138 extends within the accumulator chamber 136. The other end of the pin 138 engages a spring seat 142 located in a central opening, or spring chamber, 144 of the member 112. A compression spring 146 with a single spring constant is situated in opening 144 between the member 110 and the spring seat 142. The spring 146 normally urges the needle valve to an orifice closing position as it applies a force to the damping pin 138 with a linear rate spring. Port 148 corresponds to port 44 of the assembly of FIG. 1.

The damper plate 114 acts as a stop for the needle valve 120. The lift for the needle valve is designated in FIG. 3 by the dimensional arrows 150. As the needle valve moves toward the stop formed by the damper plate 114, the volume of the accumulator chamber 136 decreases. As the accumulator chamber decreases in volume, fuel is displaced through a leak path defined by the clearance between the pin 138 and the opening 140 formed in the damper plate 114.

The fuel intake port for the nozzle assembly of FIG. 3, shown at 148, is connected to the fuel flow intake line to the outlet side of the low-pressure fuel supply pump (not shown).

The end surface of the damper plate 114 engages adjacent surface 153 of the tip portion 116. This provides a seal for the passages 134 and 130 and also isolates the accumulator chamber 136.

When the injector pump initiates an injection cycle, pressure generated in the pumping chamber is transmitted through passages 126, 128, 130, 134 and 132. When the pressure reaches a threshold value of 5000 psi, for example, the force of the spring 146 acting on the needle valve is overcome and the needle valve shifts toward the damper plate 114. This immediately opens the orifices 118. It also exposes the conical surface 124 on the needle valve to high fuel pressure, which tends to drive the needle valve into the accumulator chamber 136. In a conventional nozzle assembly of the type as shown in FIG. 1, the needle valve immediately would strike the needle valve stop upon a pressure buildup to the threshold value. The shifting motion of the needle valve of the present invention, however, is delayed because of the damping action provided by the damping pin 138 and the fuel leak path for the fuel that is displaced in the accumulator chamber 136. In one working embodiment of the invention, the clearance between the pin 138 and the opening 140 is 0.0075 to 0.0200 mm.

A flow control orifice 152 connects the high pressure needle valve feed passage 130 with the central opening or spring chamber 144. The member 112, in which the opening or spring chamber 144 is formed, does not include a bleed passage for connecting the spring chamber with the low pressure fuel supply port 148. In this respect, the construction of applicants' invention shown in FIG. 3 differs from the prior art construction of FIG. 1 where a bleed port 154 connects the spring chamber for spring 104 to the low pressure fuel feed port 44.

As pressure builds up in passage 130 in the construction shown in FIG. 3, a pressure differential will be created between the pressure in passage 130 and the pressure in the spring chamber 144. The pressure buildup in spring chamber 144 is delayed relative to the pressure buildup in passage 130. This is indicated in FIG. 8 where the pressures in the passage 130 and in the spring chamber or opening 144 are plotted against time.

The construction of the invention shown in FIG. 3 includes a pressure bleed port 156 in the damper plate 114. Any fluid passing through the restricted flow passage around the pin 138 communicates with port 156.

Figure 8:
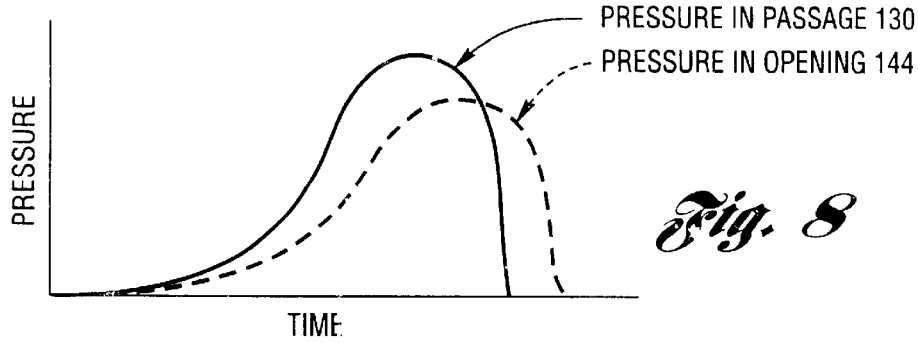
FIG. 8 is a plot of the pressures in the spring chamber and in the nozzle fuel passage versus time during an injection cycle.

Because a pressure is created in the spring chamber as shown by the dotted line plot of FIG. 8, a hydraulic force is available to close the needle valve 120. This hydraulic force complements the force of the valve spring 146. The needle valve 120 thus closes at a faster rate than the rate of closing that would result from a spring force acting alone, as in the prior art constructions. Since the needle valve closes faster following the development of a peak pilot pulse pressure and following the development of the main injection pulse, the end of the pilot pulse and the end of the main injection pulse are more precise and more controlled. This aids in emissions reduction and contributes to a precise shaping of the pilot pulse fuel delivery and the main injection pulse fuel delivery.

Figure 8A:
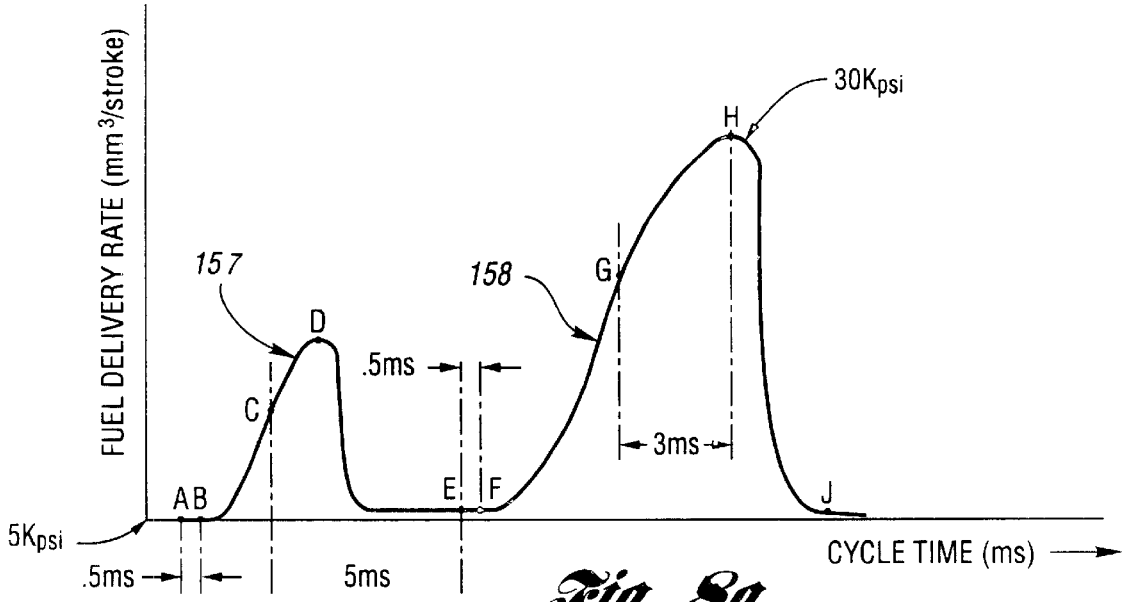
FIG. 8*a* is a plot of the fuel delivery rate as a function of cycle time showing a distinct pilot pulse and full injection pulse, which occur at discrete cycle times during the injection event.

The operation of the needle valve assembly of FIG. 3 now will be described with reference to FIG. 8*a*, which is a plot of the fuel delivery rate during the injection event. At point A, the controller for the engine issues an ON command signal to the control valve assembly. Approximately 0.5 ms later, after the control valve has moved to its closed position, the pressure builds up to a value of approximately 5000 psi, for example. This occurs at cycle time B in FIG. 8*a*. The needle valve 120 at that point is shifted toward the damper plate, thus opening the nozzles 118. Fuel delivery for the pilot injection portion of the injection event then is begun. The fuel is delivered, as indicated in FIG. 8*a* at 157, which represents the pilot injection pulse. At cycle time C in FIG. 8*a*, the controller issues an OFF command signal to the control valve. Fuel delivery continues as shown in FIG. 8*a*, however, because of the response delay inherent in the injection system and the inertia of the fuel charge itself until a peak value is reached at cycle time D. The needle valve moves from its closed position to its fully open position against the stop provided by the damper plate 114 as the fluid in the accumulator chamber 136 leaks past the damping pin 138.

At cycle time E in FIG. 8*a*, the controller again issues an ON command signal to the control valve. When that occurs, the pressure will have fallen to approximately its original value of 5000 psi. The interval between the OFF command signal at point C and the ON command signal at point E may be approximately 5 ms.

At approximately 0.5 ms after the ON command signal has issued at point E, the pressure begins to rise again, as shown at 158. This is the beginning of the main injection pulse. At cycle time G, the controller issues an OFF command signal to the control valve in advance of the time at H when the peak value for the main injection pulse is reached. Thereafter, the main injection pulse pressure falls to its original value shown at cycle time J. A delay of perhaps 3 ms occurs between the cycle time G and the cycle time at H when the maximum pressure is reached in the main injection pulse. That pressure may be approximately 30,000 psi. In contrast, the peak pressure for the pilot pulse at cycle time D may be approximately 7500 psi.

Figure 7:
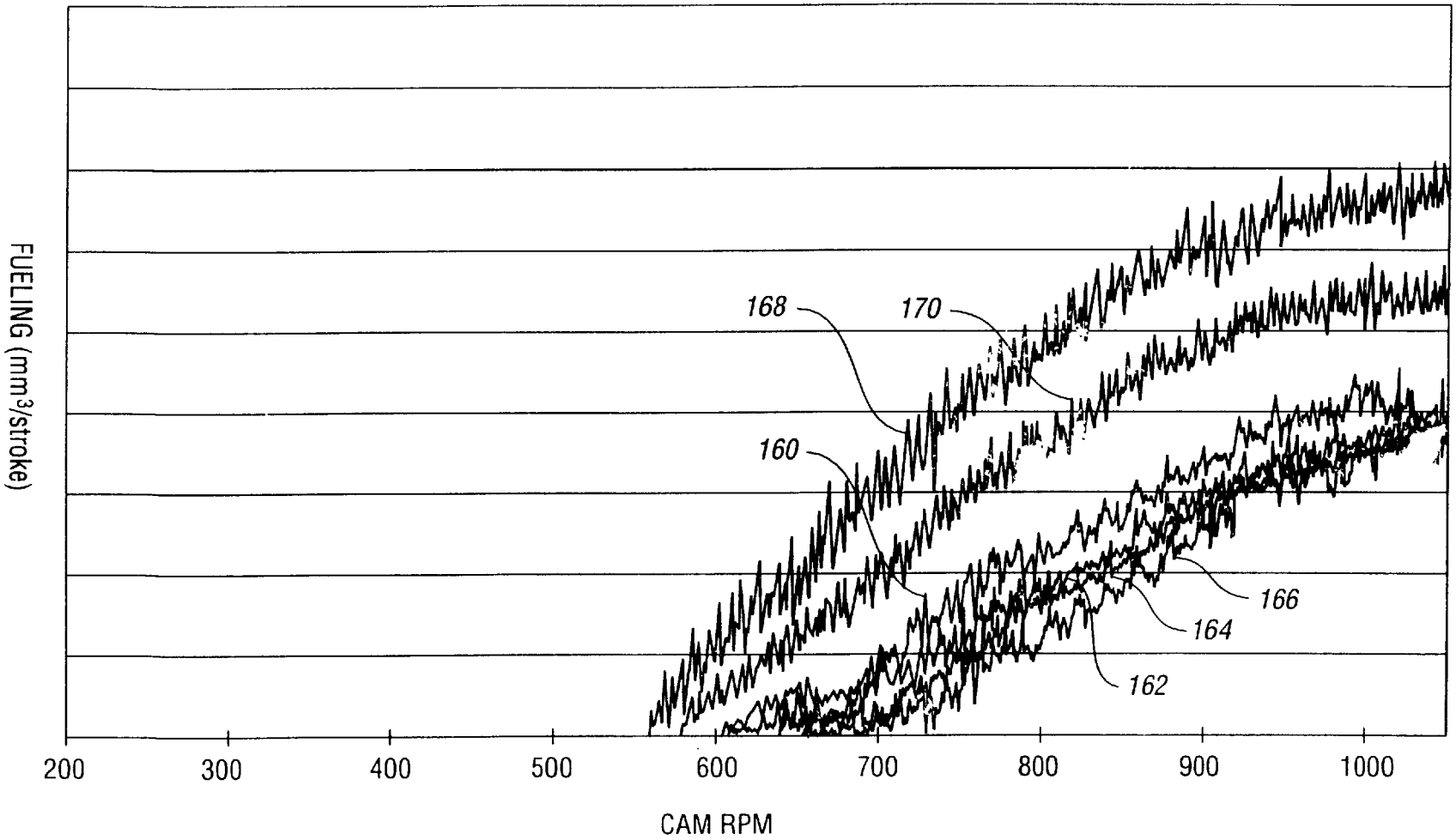
FIG. 7 is a plot of the fuel delivered through the nozzle of FIG. 3 during the pilot pulse measured in cubic millimeters per stroke as a function of the speed of the cam for the engine.

Shown in FIG. 7 are plots of the pilot pulse fueling for multiple nozzle assemblies of the invention as a function of cam rpm, which is directly related to engine speed. FIG. 7 plots the fuel delivery for each of four nozzles for an engine. The plots are separately designated at 160, 162, 164 and 166. The fueling begins at a cam speed, in the example of FIG. 7, at approximately 600 rpm. The fueling pulses are indicated by the peaks of each of the plots shown at 160–166. As the cam rpm increases, the fuel delivery increases generally linearly. The peaks are created by the sequential ON/OFF signals delivered by the controller to the control valve assembly.

The amplitude of the peaks for the plots at 160–166 is relatively modest for each of the injector nozzles in comparison to the amplitude of the peaks for a pair of conventional injectors, which are represented by the plots 168 and 170 in FIG. 7. Furthermore, the spread between the two plots 168 and 170 is greater than the corresponding spread between the plots 160–166.

The pilot pulse fueling for the nozzle assembly of the invention is demonstrated in FIG. 7 to be more efficient than the pilot pulse fueling that is achieved by a conventional nozzle assembly represented by the plots 168 and 170. This, improved efficiency is a result of the previously described characteristic shown in FIG. 8*a*, where a distinct pilot pulse at 157 is generated without blending with a subsequent full injection pulse, shown at 158.

As a result of the more precise and efficient injection event represented in the plots of FIGS. 7 and 8, the engine is able to operate with reduced undesirable exhaust gas emissions. Further, the combustion occurs at an increased temperature, and burning is more complete in the engine combustion chambers.

Because of the presence of the hydraulic pressure in the spring chamber 144, there is a reduced likelihood of cavitation caused by the spring 146. Furthermore, the presence of a higher pressure in spring chamber 144 will allow for a more lightly loaded spring during the design of the injector. Furthermore, because of the presence of the pressure in the spring chamber, the fuel delivery rate plot of FIG. 8*a* is characterized by a very steep decrease in the fuel delivery rate between points H and J in FIG. 8*a*. Thus, the main injection event is ended very precisely. Furthermore, the end of the pilot pulse is ended precisely following the development of the peak pulse pressure at point D in FIG. 8*a*.

The presence of pressure in the spring chamber or opening 144 permits the needle valve to operate normally at the beginning of the pilot pulse and at the beginning of the main injection pulse. The ending of the pilot pulse and the ending of the main injection pulse, however, are altered in a desirable fashion, as previously explained, by increasing the slope of the fuel delivery rate plot of FIG. 8*a* from the peak values shown at D and H.

Although a preferred embodiment of the invention has been disclosed, it will be apparent to persons skilled in the art that modifications may be made without departing from the scope of the invention. All such modifications and equivalents thereof are covered by the following claims.

What is claimed is:

1. A fuel injector nozzle assembly for use with a fuel injector pump in an internal combustion engine having an air/fuel mixture combustion chamber, the nozzle assembly comprising:

a nozzle housing including a nozzle tip portion, at least one fuel spray nozzle orifice in the nozzle tip portion;

a needle valve in the nozzle tip portion, a first end of the needle valve being engageable with the nozzle tip portion and closing the nozzle orifice when the needle valve assumes a first position and opening the nozzle orifice when the needle valve assumes a second position;

a damper plate adjacent a second end of the needle valve, a fuel flow passage in the damper plate;

a damper pin in the fuel flow passage, one end of the damper pin engaging the second end of the needle valve;

a compression spring with a single, linear spring constant in a spring chamber acting on the damper pin and biasing the needle valve throughout a range of movement of the needle valve between the first and second needle valve positions whereby a pilot fuel injection pulse is established as the needle valve moves from the first position to the second position;

the spring chamber being in the nozzle housing, a high pressure needle valve fuel feed passage communicating with the nozzle tip portion, a flow control orifice between the spring chamber and the high pressure needle valve fuel feed passage whereby a pressure buildup in the high pressure needle valve fuel feed passage is followed by a delayed pressure buildup in the spring chamber;

a calibrated clearance between the damper pin and the fuel flow passage thereby defining a flow restriction; and an accumulator chamber between the second end of the needle valve and the damper plate, the damper pin extending into the accumulator chamber whereby the fluid displaced from the accumulator chamber by the needle valve, as the needle valve is shifted under pressure toward the damper plate, passes through the flow restriction, the pilot fuel injection pulse being followed by a main fuel injection pulse.

2. The fuel injector nozzle assembly set forth in claim 1 wherein the needle valve has a pressure area that is subjected to fuel pressure in the high pressure needle valve fuel feed passage;

the needle valve being shifted toward the damper plate as fuel pressure in the high pressure needle valve fuel feed passage effects displacement of the spring.

3. A fuel injector nozzle assembly as set forth in claim 2 wherein the damper plate is disposed in engagement with the nozzle tip portion in the nozzle housing;

an opening in the nozzle tip portion defining in part the high pressure needle valve fuel feed passage, the damper pin extending through the damper plate fuel flow passage, the calibrated clearance thereby defining a fuel flow leak path of the fluid displaced from the accumulator chamber by the needle valve.

4. The fuel injector nozzle assembly of claim 3 wherein the first end of the needle valve is formed with a first seal area, the nozzle tip portion that is engaged by the first end of the needle valve having a second seal area that registers with the first seal area;

the first and second seal areas closing the nozzle orifice when the needle valve first end engages the nozzle tip portion;

the seal area on the needle valve first end being subjected to pressure in the high pressure needle valve fuel feed passage when the needle valve is shifted toward the damper plate.

5. The fuel injector nozzle assembly set forth in claim 1 wherein the spring creates a force acting on the damper pin, the spring force being transferred to the needle valve second end through the damper pin; the delayed pressure buildup in the spring chamber creating a hydraulic pressure force on the needle valve that complements a needle valve closing force whereby the pilot and main fuel injection pulses are ended with precision at a fast needle valve closing rate.

6. The fuel injector nozzle assembly set forth in claim 5 wherein the damper plate includes a leak flow passage extending from the fuel flow passage in the damper plate to a low pressure region of the fuel injector nozzle assembly.

* * * * *